United States Patent [19]

McDowell, Jr. et al.

[11] 3,981,421

[45] Sept. 21, 1976

[54] NONSPURTING DISPENSING CLOSURE

[75] Inventors: John David McDowell, Jr., Cincinnati; Paul John Nutley, West Chester, both of Ohio

[73] Assignee: The Procter & Gamble Company, Cincinnati, Ohio

[22] Filed: June 30, 1975

[21] Appl. No.: 592,007

[52] U.S. Cl. ..... 222/521

[51] Int. Cl.[2] ..... B65D 47/26

[58] Field of Search ..... 222/499, 521, 525, 520, 222/524

[56] References Cited

UNITED STATES PATENTS

| | | | |
|---|---|---|---|
| 2,017,140 | 10/1935 | Worth | 222/521 |
| 2,769,582 | 11/1956 | Schlicksupp | 222/521 X |
| 2,980,302 | 4/1961 | Rasmussen | 222/525 X |
| 3,370,764 | 2/1968 | Stull | 222/499 |
| 3,690,520 | 9/1972 | Sarris | 222/499 |

*Primary Examiner*—Robert B. Reeves
*Assistant Examiner*—Francis J. Bartuska
*Attorney, Agent, or Firm*—Elliot A. Lackenbach; John V. Gorman; Richard C. Witte

[57] ABSTRACT

Push-pull dispensing closure provided with interengaging angulated ribs and cooperating lugs on the exterior of the shell member chimney portion and interior of the tip member sleeve portion, respectively, to provide a limited degree of relative rotation therebetween during extension or opening movement of the tip member and finding particular utility when utilized as a dispensing closure for a bottle or container of viscous or thixotropic material requiring shaking immediately before use. This construction provides apparatus for preventing spurting upon opening of the closure after such shaking.

10 Claims, 5 Drawing Figures

PRIOR ART
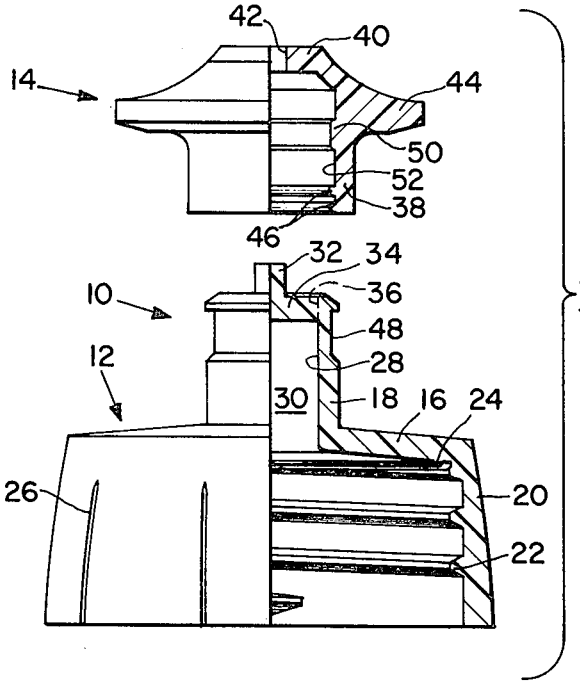
Fig. 1
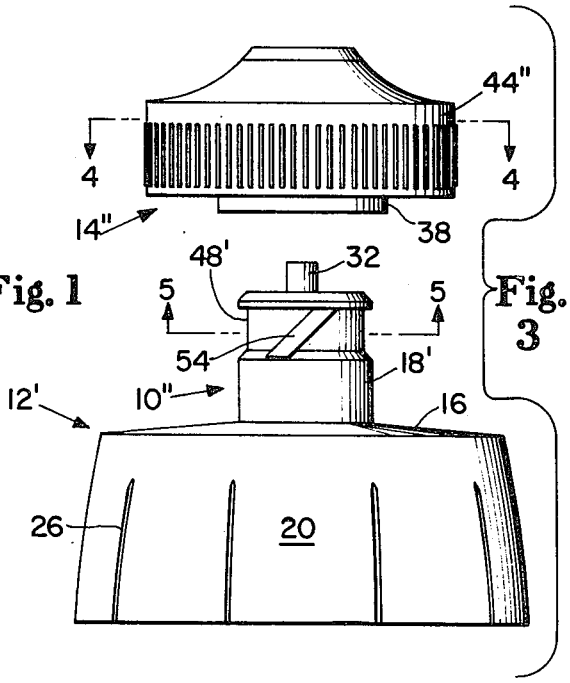
Fig. 3
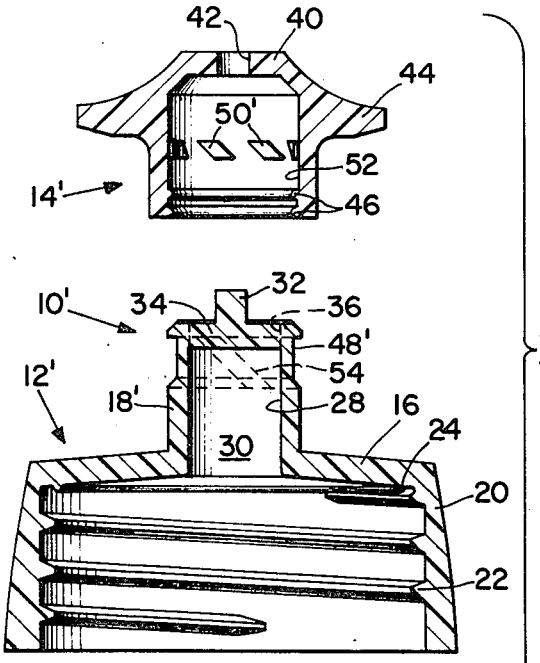
Fig. 2
Fig. 4
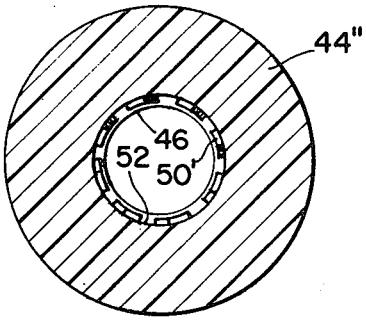
Fig. 5
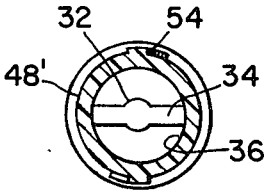

NONSPURTING DISPENSING CLOSURE

FIELD OF THE INVENTION

This invention relates to dispensing closures and to methods of preventing spurting therefrom.

DESCRIPTION OF THE PRIOR ART

Push-pull type dispensing closures have found great utility in connection with the dispensing of many fluids because of their relatively low cost, ease of operation and reliability together with the captive nature thereof which generally eliminates requirement of a separable cap.

For example, and with reference to FIG. 1, there is therein shown and illustrated an exploded view, partially in section, of a prior art push-pull dispensing closure generally designated by the reference character 10 which comprises a shell member 12 and a tip member 14, each of integral one-piece molded construction.

The shell member 12 comprises a generally annular wall portion 16 having a generally cylindrical chimney portion 18 extending generally centrally therefrom and a generally cylindrical skirt portion 20 depending generally peripherally therefrom. The skirt portion 20 is provided with internal thread means 22 for enabling the shell 12 to be screwed onto the neck or finish of a bottle, or the like, and there may be provided a generally annular rib 24 depending from the annular wall 16 generally coaxially within the skirt portion 20 for providing a seal against the end of the bottle finish. The exterior of the skirt portion 20 may, as shown, be provided with means such as generally parallel grooves 26 extending in a generally axial direction to enable the skirt portion 20 to be easily grasped for threading onto the bottle finish.

The chimney portion 18 is provided with a generally axially extending bore 28 which extends through the annular wall 60 to provide a dispensing passageway 30.

At the distal end of the chimney 18 there is provided a generally cylindrical closure plug 32 extending generally axially upwardly therefrom in the direction opposite the skirt portion 20 and mounted with the chimney as by means of a pair of opposed bridge members 34 defining a pair of generally semi-circular apertures 36 through which the product to be dispensed may flow. Other mounting means, such as, and by way of example only and without limitation, a generally continual annulus with apertures therethrough surrounding the plug 32 may also be utilized.

The tip member 14 comprises a generally cylindrical sleeve portion 38 having a bore 52 and an end wall 40 extending generally transversely thereacross and provided with a generally central dispensing aperture 42 communicating with the bore 52. The sleeve 38 is sized to closely fit over the chimney portion 18 of the shell member 12 and the dispensing aperture 42 is sized to closely fit over the closure plug portion 32 for selective opening and closing thereby. The tip member 14 further comprises a generally annular outwardly extending flange portion 44 to enable it to be readily manipulated and moved relative the shell member 12 between an open or extended position whereat the plug member 32 is withdrawn from the dispensing aperture 42 and a closed or telescoped position whereat the plug member 32 is engaged within and closes the dispensing aperture 42.

The tip member 14 is further provided with a pair of generally annular generally inwardly directed rounded sealing and guiding ribs 46 which engage the chimney portion 18 of the shell member 12 to preclude passage of any product outwardly therebetween and provide a frictional fit therewith enabling the tip member 14 to be retained thereby in either its extended or telescoped position. Further, the shell member 12 and the tip member 14 are provided with cooperating motion limiting means for limiting sliding or telescoping movement thereof to movement only between the open and closed positions and, thereby, to preclude inadvertent removal of the tip member 14 from the shell member 12. Such motion limiting means may comprise a generally annular groove 48 extending about the chimney portion 18 adjacent the distal end thereof and a generally internally directed generally annular or ring-like rib 50 provided within the bore 52 of the tip member 14. The width of the groove 48 is greater than the width of the rib 50 so that the rib 50 may move freely within the width of the groove 48 and thereby enable free telescoping movement of the tip member 14 relative the chimney 18 of the shell member 12 between the open and closed position.

The shell member 12 and the tip member 14 may be molded of material of relatively differing hardness and resilience and, as heretofore pointed out are preferable, one one-piece integral construction. The shell member 12 may, for example, be molded of a relatively rigid material, such as polypropylene, while the tip member 14 is molded of a somewhat softer, more resilient material such as high density polyethylene so that the tip member 14 may be assembled with the shell member 12 by forcing the tip member 14 over the chimney 18 of the shell member 12, the resilience of the ribs 46 and 50 being such as to enable the tip member to be ejected from the mold core without unscrewing and to enable a snap fit assembly of the tip member onto the shell member 12. Further, the materials of the shell member and tip member may be of differing thermal coefficients of expansion such that if the members 12 and 14 are assembled while still hot, such snap fit is more readily achieved.

There have also been heretofore available "twist to open" dispensing closures having a tip member threaded onto the barrel or chimney of a shell member. Such twist open dispensing closures, however, due to the necessity for full threads thereon generally are expensive to mold in that the die member forming the threads must be unscrewed from the molded part. Such closures are also less convenient for the user than push-pull type closures because of the large amount of twist necessary to unscrew the tip member sufficiently to open the closure.

Push-pull closures such as that as shown in FIG. 1 have been highly satisfactory for dispensing numerous fluid substances, such as, and by way of example only and without limitation, liquid cleaning preparations.

There have recently been developed, however, cleaning preparations which are thixotropic, having very high viscosity at low shear rates and which require that they be thoroughly mixed, as by shaking, immediately before use. Such cleaning preparations are disclosed, for example, in U.S. Pat. Application Ser. No. 415,033 entitled "Liquid Abrasive Cleaner with Hypochlorite Bleach" filed Nov. 12, 1973 by W. L. Hartman and assigned to The Procter & Gamble Company; in corresponding Belgium Pat. No. 817,443 to The Procter &

Gamble Company dated Jan. 9, 1975 and in corresponding German Pat. No. 2,432,053 to The Procter & Gamble Company laid open Jan. 30, 1975. When the push-pull closure of the type shown in FIG. 1 and hereinabove described was attempted to be utilized in connection with this thixotropic cleaner, following shaking thereof it was found that a substantial quantity of the material was retained within the closure shell, and particularly within the passageway 30 of the chimney 18 and that when the closure 10 was opened by outward pull applied to the tip member 14, in most cases a small quantity of the product spurted outwardly from the dispensing opening 42.

OBJECTS OF THE INVENTION

Bearing in mind the foregoing, it is a primary object of the present invention to provide a novel and improved anti-spurt dispensing closure.

Another primary object of the present invention, in addition to the foregoing object, is the provision of novel methods for precluding or substantially reducing spurting of dispensing closures.

Still another primary object of the present invention, in addition to each of the foregoing objects, is the provision of novel and improved dispensing closures which are economical to manufacture and durable and effective in use.

Yet another primary object of the present invention, in addition to each of the foregoing objects, is the provision of novel and improved dispensing closures capable of safe and effective use with thixotropic liquid abrasive cleaners.

Yet still another primary object of the present invention, in addition to each of the foregoing objects, is the provision of such novel and improved dispensing closures having a tip member of integral one-piece construction that can be molded without requiring unthreading of a mold core therefrom.

Yet still another primary object of the present invention, in addition to each of the foregoing objects, is the provision of such dispensing closures that can be snap fit assembled without regard to angular orientation between the tip and shell member.

The invention resides in the combination, construction, arrangement and disposition of the various component parts and elements incorporated in new and improved dispensing closures constructed in accordance with the principles of this invention and in methods of preventing spurting from dispensing closures. The present invention will be better understood and objects and important features other than those specifically enumerated above will become apparent when consideration is given to the following details and description which, when taken in conjunction with the annexed drawing describes, discloses, illustrates and shows certain preferred embodiments or modifications of the present invention and what is presently considered and believed to be the best mode of practising the principles thereof. Other embodiments or modifications may be suggested to those having the benefit of the teachings herein, and such other embodiments or modifications are intended to be expressly reserved, especially as they fall within the scope and spirit of the subjoined claims.

SUMMARY OF THE INVENTION

In accordance with the present invention there is provided, within a push-pull type closure, a pair of angulated ribs on the chimney of the shell member and a plurality of angulated cooperating lugs in the bore of the tip member to provide a small degree of angular rotation of the tip member relative the shell member during opening and closing thereof to prevent spurting of product during opening as may occur in dispensing of a thixotropic material requiring shaking before use.

DESCRIPTION OF THE DRAWING

While the specification concludes with claims particularly pointing out and distinctly claiming the subject matter which is regarded as forming the present invention, it is believed the invention will be better understood from the following detailed description when taken in conjunction with the annexed drawing which discloses, illustrates and shows certain preferred embodiments or modifications of the present invention and what is presently considered and believed to be the best mode of practising the principles thereof and wherein;

FIG. 1 is an exploded elevational view, partially in section, of a prior art push-pull dispensing closure;

FIG. 2 is an exploded elevational cross-sectional view of an improved dispensing closure constructed in accordance with the principles of the present invention;

FIG. 3 is an exploded elevational view of a further improved dispensing closure constructed in accordance herewith;

FIG. 4 is a cross-sectional view taken along line 4—4 of FIG. 3; and FIG. 5 is a cross-sectional view taken along line 5—5 of FIG. 3.

DETAILED DESCRIPTION OF THE INVENTION

As has been heretofore pointed out, the present invention comprises an improvement to the prior art dispensing closure shown and illustrated in FIG. 1 and described hereinabove in detail. The present invention is shown and illustrated in FIGS. 2–5, inclusive, and for simplicity like references characters will be utilized in connection with the various component parts and elements shown and illustrated in FIGS. 2–5 as have been hereinbefore utilized in detailing the prior art dispensing closure shown and illustrated in FIG. 1. Moreover, those portions of the improved dispensing closure shown in FIGS. 2–5 that have not been changed from the prior art dispensing closure shown and illustrated in FIG. 1 will not be redescribed in detail, only the differences therefrom being hereinafter described and detailed and the modified component parts and elements will be hereinafter referred to by the same reference character as utilized in FIG. 1, except that the reference characters for such changed component parts and element will be primed or double primed, as necessary to distinguish between the various modifications and embodiments.

Accordingly, with reference now to FIG. 2, the improved dispensing closure 10' comprises a shell member 12' and a tip member 14'. The internal construction and general arrangement of the shell member 12' is identical to that of the shell member 12 of the prior art closure 10 of FIG. 1 and the external construction and general arrangement of the tip member 14' is identical to that of the tip member 14 of the prior art closure 10 of FIG. 1.

The tip member 14' of the improved dispensing closure 10' has been modified so that the continuous annular ring-like rib 50 of the prior art tip member 14 has been made discontinuous to provide, in the improved tip member 14', a plurality of lugs 50' and the groove 48 of the prior art shell member 12 has been modified to provide, in the improved shell member 12, a pair of angulated ribs 54 in the groove 48' of the shell member chimney 18'.

Preferably, two angulated ribs 54 are provided extending generally perpendicular the parting line of the improved shell member 12' so that the angulated ribs 54 may be readily and easily molded. The ribs 54 preferably extend at an angle of approximately 45° to the axis of the shell member chimney 18'.

The lugs 50' are preferable of quadrilateral shape with a minimum of one edge and preferably two side edges parallel the edge of the angulated rib 54. Preferably also, the spacing between the lugs 50' in only slightly greater than the thickness of the rib 54 and an even number of lugs should be used so that both ribs 54 are engaged by the cooperating lubs 50', simultaneously preferably, eight lugs 50' are provided but more or less lugs 50' from, for example, about two to about twenty lugs 50' may be provided. The interengagement of the angulated ribs 54 and lugs 48' provides a low angle slight twisting movement to the tip member 14' as it is pulled outwardly of the shell member 12'. The slope of the ribs 54 and lugs 50' is substantially greater than "twist to open" closures and the low angle twist imparted thereby is substantially less.

The slope and number and size of the ribs and lugs may vary. Similarly, the range of the slope of the ribs 54 and the cooperating edges of the lugs 50' may also vary up to about 50° but the slope should be selected to be preferably approximately 45° and within the range of about 35° to about 50° so that push-pull movement of the tip member 14' on the shell member 12' provides the required camming for the necessary twisting movement.

The tip member 14', like the tip member 14 is preferably molded from a resilient material, such as polyethylene, such that the lugs 50' may be molded and subsequently released from the mold core member by a snap action, without requiring unscrewing of the mold core member from the tip member 14'. The tip member 14' may be snapped onto the chimney 18' for easy assembly without regard to angular orientation.

It has been found that the addition of the ribs 54 to the shell member 12' and the provision of the lugs 50' within the tip member 14' of the improved dispensing closure 10' is effective to prevent spurting of viscous or thixotropic materials such as is described in the above referenced Hartman application and patents.

The material of the aforesaid Hartman application, however, in addition to being viscous and thixotropic is also abrasive and excessive wear of the lugs 50' may occur if the tip member 14' is actuated solely by a push-pull manipulation since substantial frictional camming forces can be developed thereby between the ribs 54 and the cooperating edges of the lugs 50' with the abrasive material therebetween. It has been found, however, that such excessive wear can be substantially reduced by the provision of means associated with the tip member for encouraging the user or operator to apply a twisting force to the tip member during push-pull actuation thereof and thereby relieve at least some of the camming pressure from the ribs 54 and cooperating lugs 50'.

Accordingly, and with reference now to FIG. 3, there is shown and illustrated therein a yet further improved dispensing closure designated generally by the reference character 10'' and constructed in accordance with the present invention utilizing the improved shell member 12' and a further modified and improved tip member 14''. The internal construction of the tip member 14'' of the improved dispensing closure 10'' is identical to the internal construction of the improved tip member 14'. Similarly, the outside configuration of the improved tip member 14'' is also identical to that of the tip member 14 and 14' except that the annular flange 44'' has been extended generally cylindrically and then provided with knurling, or the like, to encourage grasping thereof for the application of twisting forces combined with push-pull forces and to discourage insertion of the user's or operator's fingers beneath the flange 44'' and simple application of push-pull forces thereto. Hence, the improved tip member 14'' is naturally slightly twisted as it is pulled, and wear of the lugs 50' and ribs 54 is reduced.

As heretofore pointed out, the shell member 12' shown and illustrated in FIGS. 2 and 3 are identical, as are the internal constructions of the tip members 14' and 14''. Hence, although cross sectional grooves 4 and 5 have been taken from FIG. 3, the respective cross sections of FIG. 2 are identical thereto.

While the invention has been described, disclosed, illustrated and shown in terms of certain embodiments or modifications which it has assumed in practice, such other embodiments or modifications as may be suggested to those having the benefit of the teachings herein are intended to be expressly reserved especially as they fall within the scope and breadth of the claims here appended.

What is claimed is:

1. In a dispensing closure having a generally cylindrical chimney portion projection from a shell member and a tip member with a generally cylindrical bore slidably disposed thereon having a generally central dispensing opening and movable between an extended open position and a telescoped closed position and wherein there is provided an undercut generally annular groove extending generally peripherally around the shell member chimney portion and means carried by the tip member within said bore thereof for engagement within said groove to limit movement of said tip member relative said shell member to movement between the open and closed positions thereof, the improvement comprising means for restricting the movement of the tip member relative the shell member chimney portion to a low angle slight twisting motion during push-pull movement to thereby reduce spurting of product during opening movement thereof; said movement restricting means comprising at least one high slope angulated rib extending across and only partially around said shell member chimney portion undercut groove and a pair of circumferentially spaced apart lugs carried by said tip member extending into said bore thereof for engaging said at least one rib on opposite sides thereof to impart said slight twisting motion to said tip member during movement thereof between said open and said closed positions.

2. Closure defined in claim 1 wherein said shell member chimney portion is provided with a pair of such high slope angulated ribs extending across said shell member chimney portion undercut groove at substantially identical slopes and at diametrically opposed portions thereof and wherein said tip member comprises a series of such circumferentially spaced apart lugs equally spaced apart substantially the width of said angulated ribs for engaging said ribs substantially without regard to the orientation therebetween during assembly thereof.

3. Closure defined in claim 1 wherein said rib is disposed at between approximately 35° and approximately 50° to the longitudinal axis of said chimney.

4. Dispensing closure defined in claim 3 wherein said rib is disposed at approximately 45° to said chimney axis.

5. Dispensing closure defined in claim 1 wherein each of said lugs is quadralateral having at least one edge generally parallel said rib.

6. Closure defined in claim 5 wherein said pair of lugs comprise two adjacent lugs of a series of substantially identical lugs serially arranged annularly within said bore and spaced apart by generally only slightly more than the width of said rib.

7. Dispensing closure defined in claim 1 further comprising an elongated generally cylindrical flange on said tip member encouraging user application of twisting motion thereto and discouraging user application of straight push-pull movement thereto.

8. Nonspurting dispensing closure for a liquid product comprising a shell member of integral, one-piece molded construction having a generally tubular hollow chimney portion projecting therefrom carrying an axially aligned generally cylindrical closure plug portion on the distal end thereof and being provided with a generally annular groove portion extending about the chimney portion adjacent said distal end thereof and a pair of angulated ribs obliquely extending at a high slope across diametrically opposite portions of said groove; and a tip member of integral one-piece molded construction slidably disposed on said shell member and movable between an extended open position and a telescoped closed position, said tip member having a generally cylindrical bore sized to closely fit over said chimney portion of said shell member and closed by an end wall provided with a generally central dispensing aperture sized to closely fit over the closure plug portion for selective opening and closing thereby upon movement of said tip member between said extended open position and said telescoped closed position, and a series of lugs extending annularly within said bore having generally parallel side edges extending obliquely at substantially the same slope as said angulated ribs of said shell member, said lugs being spaced apart substantially the width of said angulated ribs and being of a length generally less than the width of said groove on said chimney portion, said series of lugs being longitudinally positioned within said bore to extend into said groove of said chimney portion to limit axial extension of said tip member outwardly along said chimney portion and preclude inadvertent disassembly thereof while opposite pairs of said lugs engage opposite sides of said angulated ribs to impart a slight twisting motion to said tip member during movement thereof between said open and closed positions to thereby reduce spurting of liquid product therefrom during opening movement thereof.

9. Nonspurting dispensing closure defined in claim 8 in combination with a product container and a liquid product which is thixotropic, having very high viscosity at low shear rates and which requires that it be thoroughly mixed, as by shaking, immediately before use.

10. Dispensing closure defined in claim 8 wherein at least said tip member is molded of a plastic material of sufficient resilience so as to be molded and subsequently released from the mold core member by a snap action, without requiring unscrewing of the mold core member from the tip member 14 and so that said tip member may be snapped onto said chimney portion for easy assembly without regard to angular orientation.

* * * * *